US005190453A

United States Patent [19]

Le et al.

[11] Patent Number: 5,190,453

[45] Date of Patent: Mar. 2, 1993

[54] STAGED COMBUSTOR

[75] Inventors: John O. Le, Yorba Linda; Charles L. Stone, Corona; Myron L. Tapper, Placentia, all of Calif.

[73] Assignee: Rockwell Internationl Corporation, Seal Beach, Calif.

[21] Appl. No.: 663,215

[22] Filed: Mar. 1, 1991

[51] Int. Cl.[5] ..... F23D 21/00

[52] U.S. Cl. ..... 431/170; 431/7; 422/173; 422/177; 422/176; 422/211

[58] Field of Search ..... 431/7, 10, 170, 326; 422/171, 172, 173, 177, 200, 211, 197, 190; 60/423, 432

[56] References Cited

U.S. PATENT DOCUMENTS 3,910,042 10/1975 Yuge et al. ..... 422/173 X 4,101,287 7/1978 Sweed et al. ..... 422/200

4,354,821 10/1982 Kesselring et al. ..... 431/7

4,870,824 10/1989 Young et al. ..... 60/723

4,916,904 4/1990 Ramsaier et al. ..... 60/723

*Primary Examiner*—Carl D. Price

*Attorney, Agent, or Firm*—Lawrence N. Ginsberg; Charles T. Silberberg

[57] ABSTRACT

A staged combustor including a first combustion stage for combusting a fuel rich mixture of a fuel and an oxidizer. A plurality of serially positioned secondary combustion stages, downstream the first stage, are provided for receiving secondary flows of oxidizer to the increasing mass of combustion efflux. The gradual increase of oxidizer/fuel ratios provide a resultant substantially stoichiometric combustion. A cooling system is provided for cooling these combustion stages.

9 Claims, 7 Drawing Sheets

STAGED COMBUSTOR

BACKGROUND OF THE INVENTION

1. Field of the Invention

The present invention relates to staged combustors and more particularly to a staged combustor which provides a substantially stoichiometric combustion.

2. Description of the Related Art

In the course of investigating possible power systems for Lunar and Mars surface system applications, present co-applicant, C. L. Stone, developed a Closed Cycle Power System (hereinafter "CCPS") which is the subject of co-pending patent application Ser. No. 07/663,219, filed concurrently herewith and assigned to the present Assignee. Effective use of the CCPS resulted in the requirement of a combustor which could generate thermal energy from the combustion of input propellants and transfer that energy to the working fluid. Additionally, to the used in the CCPS successfully, the effluent from the combustion process was required to be identical to the working fluid, thus avoiding resulting problems if the working fluid and the exhaust products are separated. Furthermore, complete stoichiometric combustion of input products and provision of an efficient cooling of the combustor were additional design requirements.

SUMMARY OF THE INVENTION

These and other objects have been achieved by the present invention which is a staged combustor including a first combustion stage for combusting a fuel rich mixture of a fuel and an oxidizer. A plurality of serially positioned secondary combustion stages, downstream the first stage, are provided for receiving secondary flows of oxidizer to the increasing mass of combustion efflux. The gradual increase of oxidizer/fuel ratios provide a resultant substantially stoichiometric combustion. A cooling system is provided for cooling these combustion stages.

The preferred fuel is $H_2$ and the preferred oxidizer is $O_2$. The combustion stages are provided by utilization of a plurality of axially disposed parallel spaced combustor cartridges. Each combustor cartridge includes an alternating series of axially spaced mixing chambers and catalyst bed compartments.

Hydrogen is introduced in the most forward of these mixing chambers, resulting in fuel rich combustion in the catalyst bed compartment adjacent thereto. The resultant gradual addition of oxidizer at downstream mixing chambers provides substantially stoichiometric combustion.

The spaces between the combustor cartridges from coolant steam passageways, the coolant steam providing cooling of these combustor cartridges. The resulting combustion products mix with the coolant steam at the outlet to form a mixed efflux matching the requirements of the aforementioned CCPS.

Other objects, advantages and novel features of the present invention will become apparent from the following detailed description of the invention when considered in conjunction with the accompanying drawings.

BRIEF DESCRIPTION OF THE DRAWINGS

FIG. 1 is a diagrammatic illustration of the closed cycle power system (CCPS) for which the staged combustor of the present invention is particularly adapted for use with.

The same elements or parts throughout the figures of the drawings are designated by the same reference characters.

DETAILED DESCRIPTION OF THE PREFERRED EMBODIMENT

Figure 1:
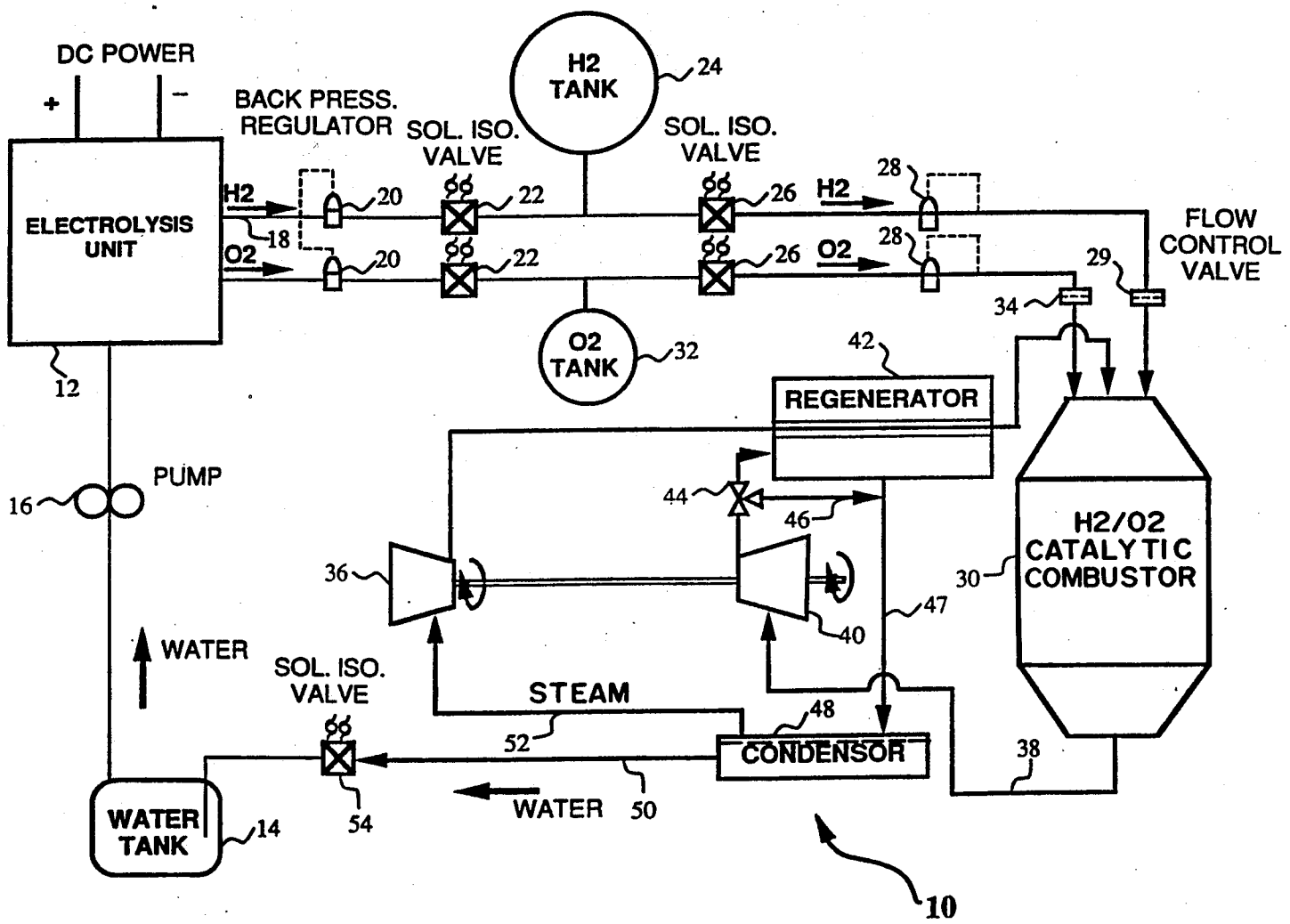

Referring to the drawings and the characters of reference marked thereon, FIGS. 3*a*–3*b*, 4 and 5 illustrate the staged combustor of the present invention, designated generally as 74. To properly understand the environment in which this combustor 74 is particularly adapted for use, FIGS. 1 and 2 have been included which illustrate the Closed Cycle Power System (CCPS). It is understood that the following description of the CCPS operating environment is shown by way of illustration and not limitation.

FIG. 1 illustrates the CCPS, designated generally as 10. An electrolysis unit 12 (described in detail below) receives water from a water source 14 via pump 16. Electrolysis unit 12 separates the water into high pressure hydrogen ($H_2$) and oxygen ($O_2$).

The hydrogen is delivered over line 18 through back pressure regulator 20 and solenoid isolator valve 22 to a hydrogen storage tank 24 which can supply pressurized hydrogen on its output line. Pressurized hydrogen is supplied to a catalytic combustor 30 via a second isolator valve 26, back press regulator 28 and flow control valve 29.

An oxygen outlet of the electrolysis unit 12 delivers oxygen to an oxygen storage tank 32 providing pressurized oxygen. Oxygen is fed from tank 32 to the catalytic combustor 30 through a backpressure regulator 28 and flow control valve 34.

As will be explained in detail below, the combustor of the present invention is a staged combustor having a first combustion stage for combusting a fuel rich mixture of a fuel and an oxidizer and, a plurality of serially positioned secondary combustor stages, downstream from the first stage. The secondary combustion stages receive secondary flows of oxidizer to an increasing mass of combustion efflux. The gradual increase of oxidizer/fuel ratios provides a resultant substantially stoichiometric combustion.

Combustor 30 is designed to operate at the optimum stoichiometric ratio to maximize its thermal efficiency. The combustion efflux from the combustion is introduced to an engine 36, 40, preferably comprising a turbo-compressor unit. The system 10 is designed to accept a constant mass flow 38 of propellant into the turbine inlet. The enthalpy energy into the turbine 40 is controlled by the propellant flow into the combustor cartridges of the combustor.

The high temperture steam efflux from the turbine 40 is then introduced to a regenerator 42 via valve 44. The regenerator 42 preferably includes a counterflow heat exchanger. A failsafe bypass 46 is activated when the temperature of the catalytic combustor 30 becomes too high. The discharge from the regenerator 42 is cooled and introduced to a condenser/radiator 48. The condenser 48 is used to liquefy and capture a controlled portion 50 of the water vapor issuing out of the turbine exhaust.

The controlled portion 50 of the steam which is condensed by condenser 48 is substantially equal to the mass flow input of propellant into the catalytic combustor 30. The remaining steam 52 emerging from the condenser 48 is delivered to the compressor 36. The compressed remaining portion of steam output from the compressor 36 is then introduced into the cold side of the regenerator 42. Its temperature is increased and it is then delivered to the catalytic combustor to serve as a coolant, closing a loop of the subject power cycle, as will be described in detail below.

The condensate 50 from the condenser 48 is directed through a solenoid isolator valve 54, stored in the storage tank 14 and is delivered on demand through the high pressure pump 16 back to the electrolysis unit 12.

Figure 2:
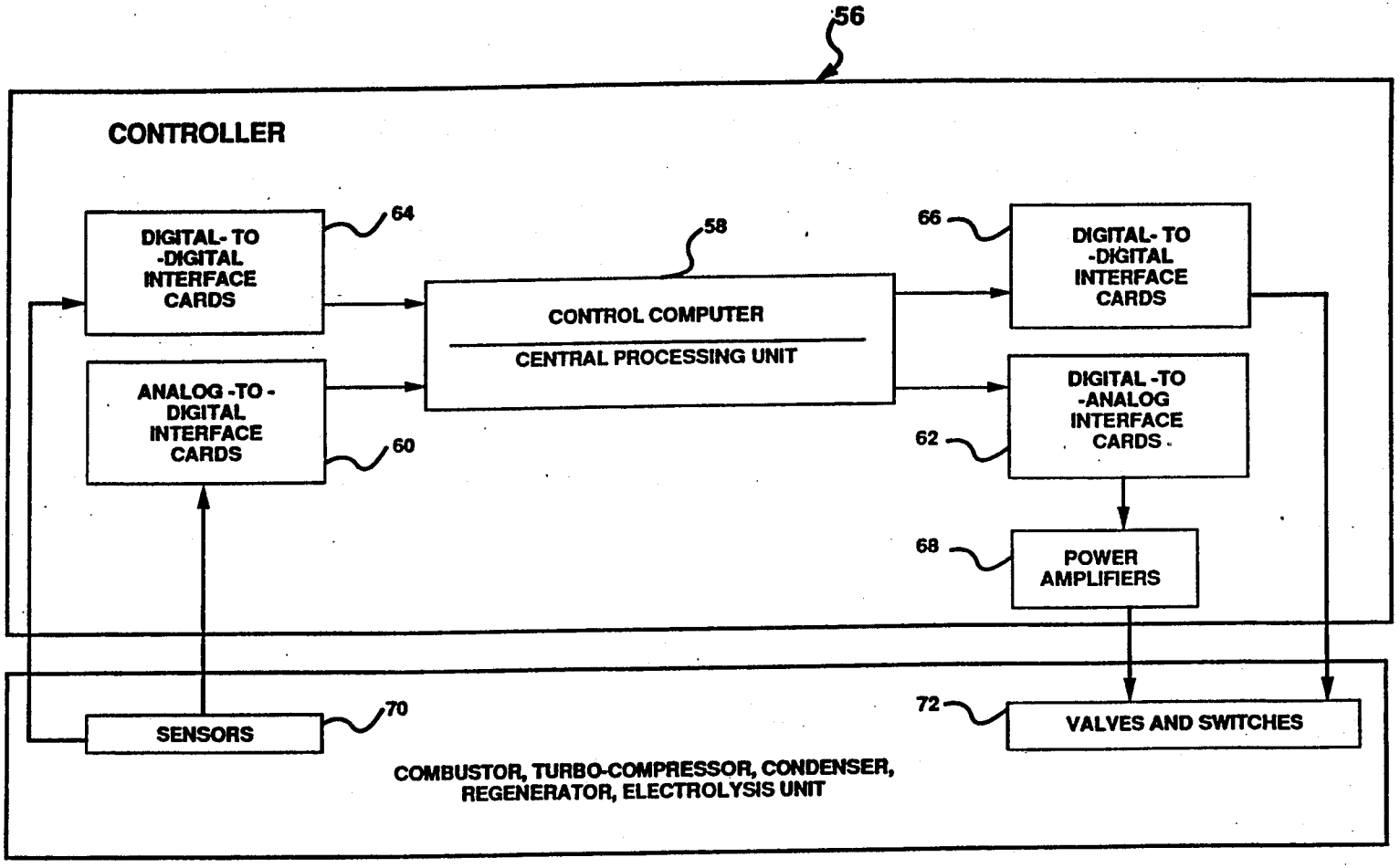
FIG. 2 is a functional block diagram of the controller used in the CCPS.

Referring now to FIG. 2, the controller 56 for the present invention comprises a Central Processing Unit 58, analog-to-digital converter input cards 60, digital-to-analog converter output cards 62, digital-to-digital input cards 64, digital-to-digital output cards 66, and power amplifier cards 68.

The controller 56 should be operated with at least a 10 Mhz clock rate and with preferably at least 1 mega byte RAM (random access memory). Controller 56 uses a VME bus to internally interface with input/output cards and a VME and/or Ethernet bus to interface with an outside computer for data recording and display.

The digital-to-digital input cards 64 and analog-to-digital input cards 60 acquire feedback information from the various sensors 70 which measure the temperature, pressure, oxygen existence, oxygen flow rate, hydrogen flow rate, steam flow rate, engine speed, coolant flow rate, water level, valve positioning, and other information from various locations within the system 10.

The controller 56, after acquiring sensing signals from the various sensors 70 and comparing these signals with reference signals, will send commands to digital output cards 66 and to digital-to-analog cards 62. The digital output cards 66 then deliver the digital commands to the sensors and control devices 72 that can accept digital commands. The digital-to-analog output cards 62 deliver command signals to the power amplifiers 68 which can deliver sufficient power to drive the actuators of the control devices 72 which use analog signals.

Figure 3A:
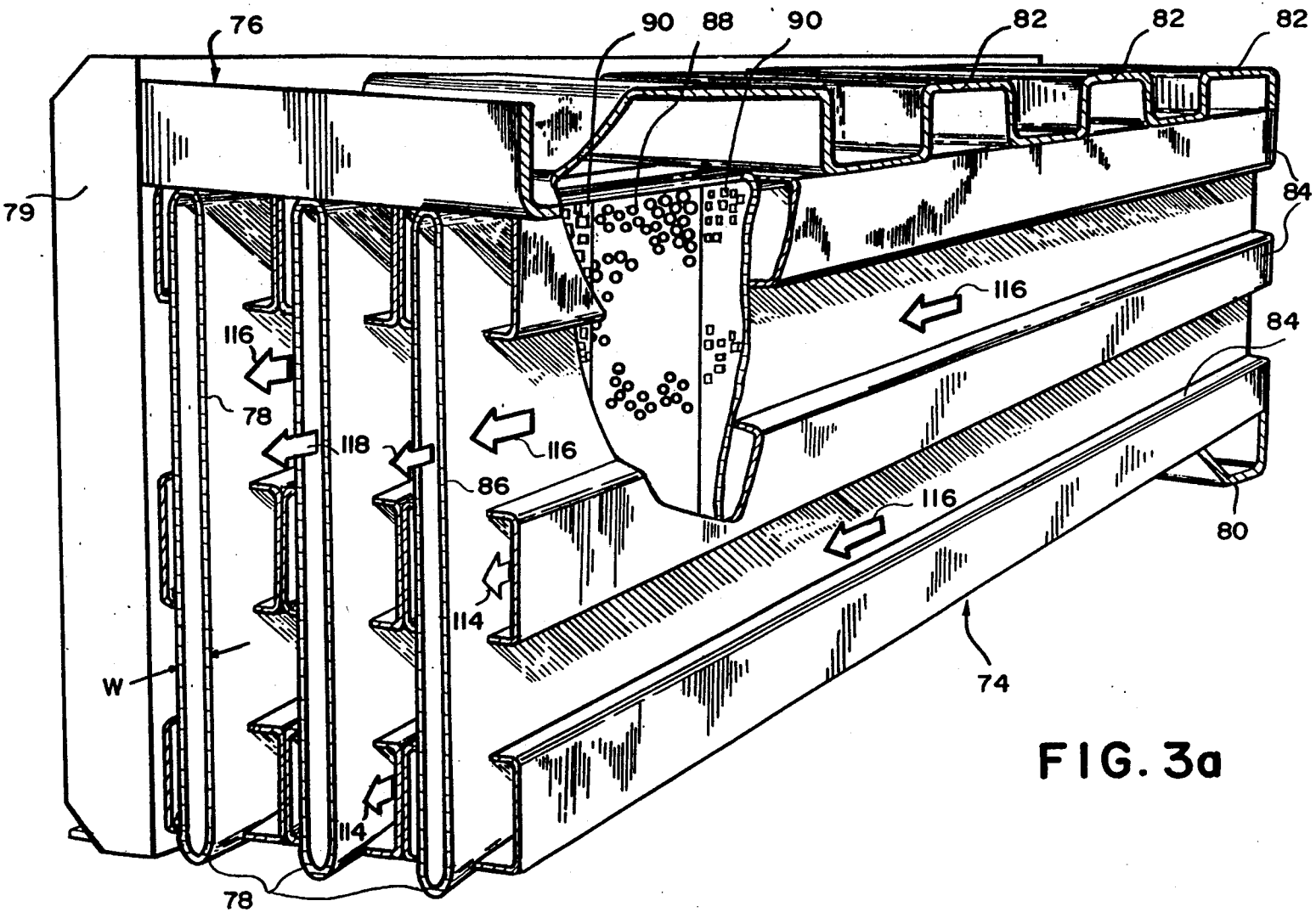
FIG. 3*a* is a rear perspective view of a portion of the staged combustor of the present invention.

Referring now to FIG. 3*a* a rear perspective view of a portion of the catalytic combustor of the present invention is illustrated, designated generally as 74. Catalytic combustor 74 includes a housing 76 having a plurality of parallel, spaced combustor cartridges 78 contained therewithin. (Although FIG. 3*a* illustrates three combustor cartidges, there are fifteen cartridges in the present embodiment. The number of cartridges may vary depending upon the desired level of horsepower.) The combustor 74 includes a rear flange 79 for connection to an output plenum. Housing 76 is formed of a high temperature metal alloy, preferably Inconel.

The bottom of the front portion of the catalytic combustor 74 includes fuel inlet means, i.e. a hydrogen feed plenum 80, which extends along the width of the combustor 74 for supplying $H_2$ to the combustor cartridges 78. The top of the catalytic combustor 74 includes oxidizer inlet means, i.e. axially spaced oxidizer feed plenums 82, for introducing the desired quantity of oxygen to the combustor cartridges 78, as will be described below. Each cartridge 78 preferably includes eight axially spaced compartments and each compartment is directed along an axis perpendicular to the direction of coolant steam flow. Elongated, heat transfer cooling fins 84 are welded to the sidewalls 86 of the combustor cartridges 78. The first compartment of each combustor cartridge 78, at the entrance of the combustor 74, is a mixing chamber (hidden from view in FIG. 3*a*). The second compartment is a catalyst bed compartment (also hidden from view). The third compartment is another mixing chamber which is followed by another catalyst bed compartment and so on. Thus, an alternating series of catalyst bed compartments and mixing chambers are provided along the length of each combustor cartridge 78. In FIG. 3*a*, portions of the cooling fins 84 and sidewall 86 have been cut away to expose a mixing chamber, designated 88 and catalyst bed compartments, designated 90.

Each catalyst bed compartment 90 is packed with a hydrogen oxidizer catalyst such as an activated crushed aluminum oxide ($Al_2O_3$) coated with a precious metal, such as that marketed by Shell Oil Company under the name "SHELL 405". This product uses iridium layered onto aluminum oxide balls and is covered by U.S. Pat. No. 4,124,528.

Each mixing chamber 88 includes granular particles to promote mixing. These particles are preferably nickel based alloys. Other high temperature materials, which are also inert to the hydrogen/oxygen combustion process, may be used. High temperature ceramics such as those that are silica based may be used.

The mixing chamber may contain, for example, the following materials: silica, sand, fused zirconia/silica, fused zirconia/magnesium, carbon chrome steel balls, 440 stainless steel balls or nickel shot.

Figure 3B:
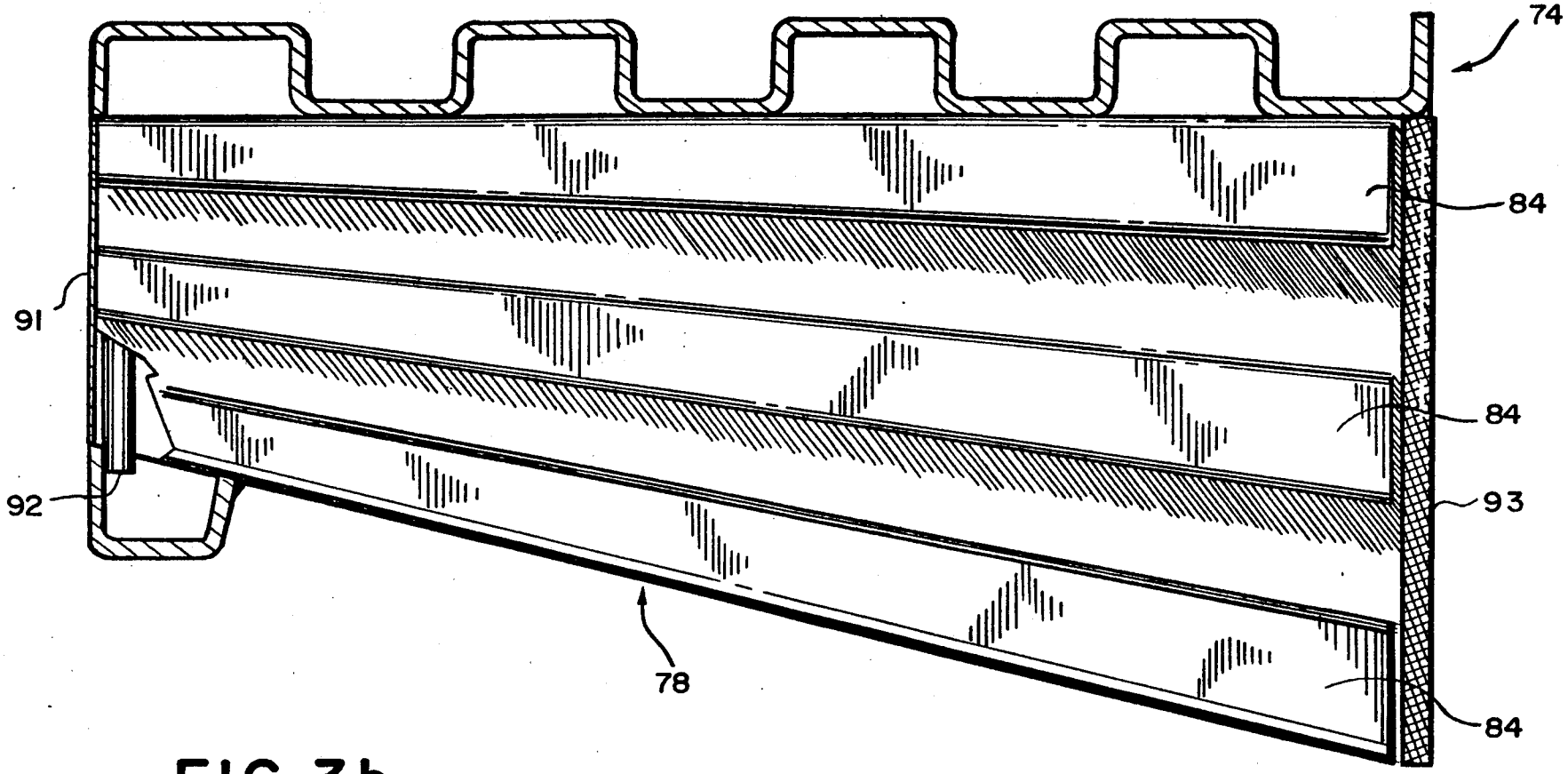
FIG. 3*b* is a side view of the staged combustor of FIG. 3*a*.

As can be seen by reference to FIG. 3*b* the front edge 91 of each cartridge 78 is closed. However, a hydrogen spray bar 92, extends vertically through the front of each combustor cartridge 78. Thus, hydrogen is released to the front of each of the combustor cartridges 78. The rear end of each cartridge 78 is open so that product steam can flow out and mix with the coolant steam. A screen 93 is spot welded to the rear of the combustor 74 for holding the contents of the combustor cartridge 78 in place.

Figure 3C:
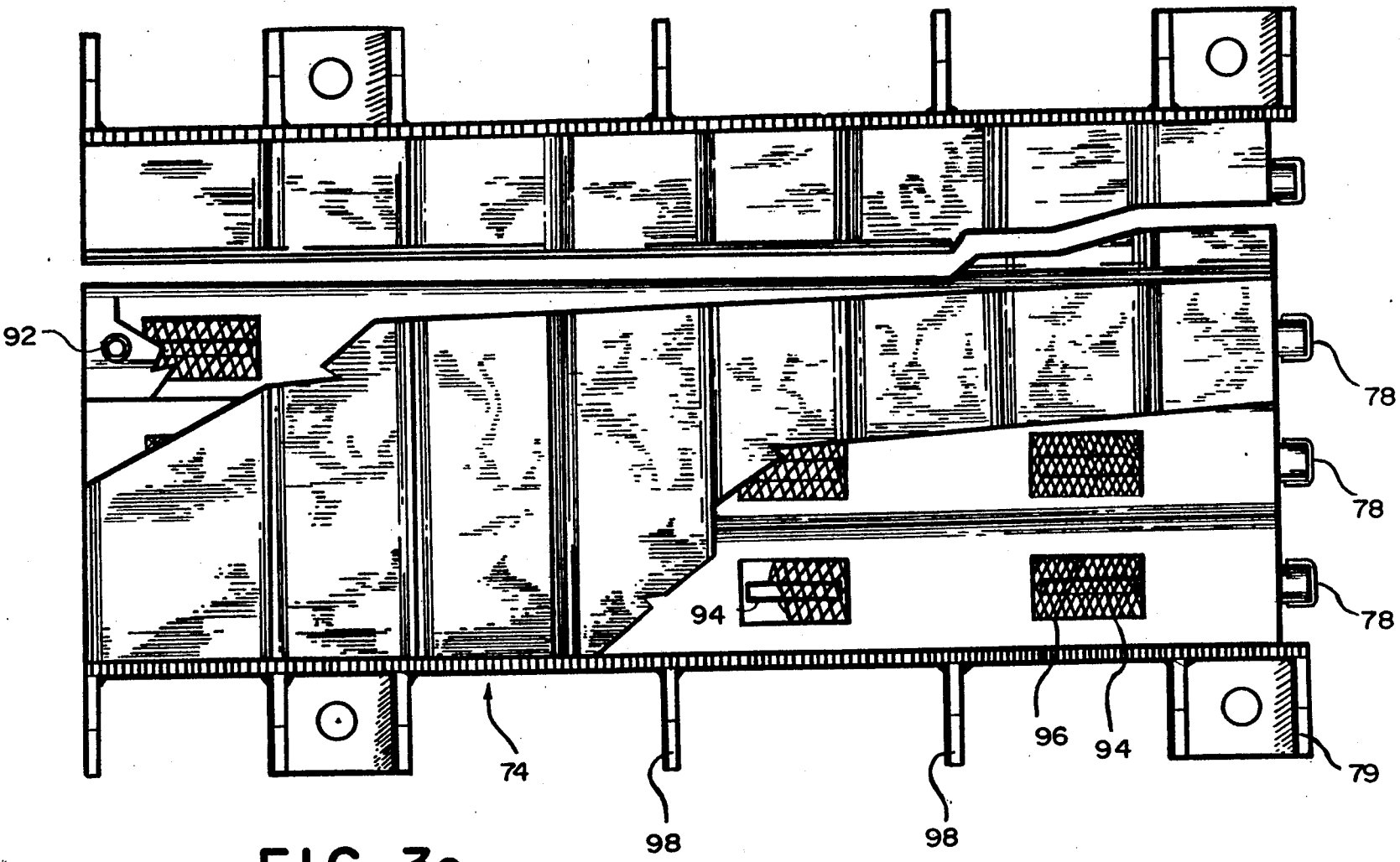
FIG. 3*c* is a top view of the staged combustor of FIG. 3*a*, partially cut away to expose oxygen feed slots.

Referring now to FIG. 3*c*, a top view of the combustor 74 is illustrated which is partially cut away to expose oxygen feed slots 94 for providing flows of oxygen to the combustor cartridges 78. This figure also illustrates the use of a stiffener 98 to prevent undesired lateral pressure when the catalytic combustor 74 is pressurized.

A protective screen 96 is provided over each of the oxygen feed slots 94. Each inlet provides a flow of $O_2$ to a respective mixing chamber.

Figure 4:
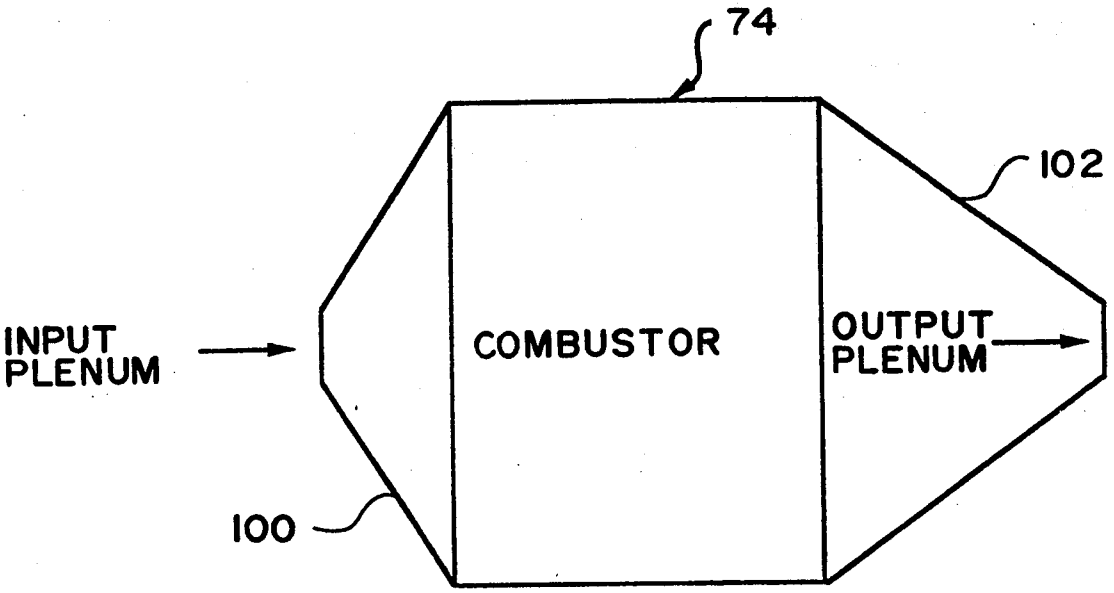
FIG. 4 is a top schematic representation of the staged combustor, including its input and output plenums.

Referring now to FIG. 4, a schematic top view of the combustor 74 is illustrated. A steam inlet plenum 100 includes an outwardly tapered duct providing flow to the combustion chamber of the combustor 74. A steam outlet 102 to the combustion chamber includes a reverse taper.

As can be readily seen by reference to FIG. 3*b*, the bottom surface of each cartridge 78 is angled to provide an expanding cross sectional area from inlet to outlet. This accommodates the expanding volume of gas in the combustor from front to rear.

Figure 5:
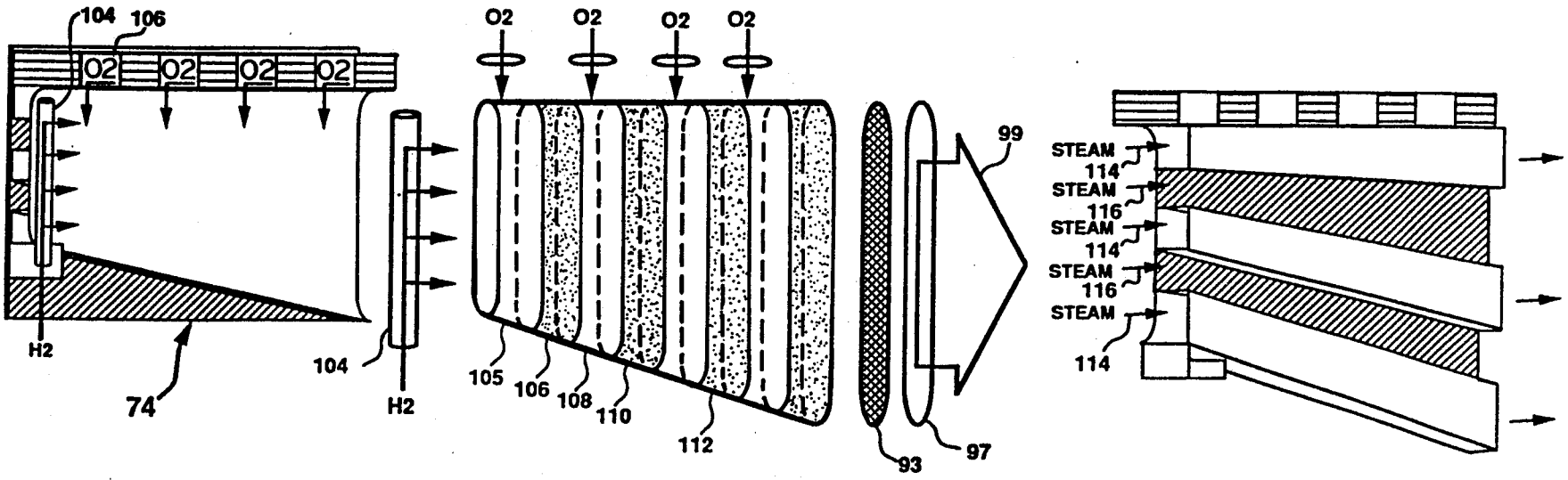
FIG. 5 is a schematic functional diagram illustrating the operation of the staged combustor of the present invention.

Referring now to FIG. 5, a schematic functional diagram of the combustor 74 of the present invention is illustrated. During operation, hydrogen is directed through the hydrogen fuel spray bar 104 into the first mixing chamber 105, where it mixes with oxygen from the first oxygen plenum.

A first quarter of the burn takes place in the first catalyst bed compartment 106. In a second mixing chamber 108, more oxygen is mixed with the fuel rich combustion efflux. A second quarter of the burn takes place in the second catalyst bed compartment 110. Three-quarters of the burn is completed by the third catalyst bed compartment 112. Combustion is complete at the outlet. (Screen 93 and a window frame 97 for retaining the same represent the outlet in this Figure, the resulting combustion efflux being represented by arrow 99.)

Thus, a staged combustion process is provided. The first combustion stage combusts a fuel rich mixture of fuel and oxygen. The serially positioned secondary combustion stages downstream the first stage receive secondary flow of the oxidizer to the increasing mass of combustion efflux. The gradual increase of oxidizer/fuel ratios provide a resultant substantially stoichiometric combustion. The oxidizer to unburned fuel mixture mass ratios commencing with the first catalyst bed chamber are 2/1, 8/3, 4/1 and 8/1, respectively.

This extremely efficient combustion process requires an efficient cooling mechanism. Steam from the regenerator is introduced to the inlet plenum of the combustor. As can be seen in FIG. 3*a*, the steam is directed through the fins 84, as shown by arrows 114. It is also directed between the fins, as shown by arrows 116. However, this steam from the regenerator is kept separate from the combustion products in the combustor cartridges 78 (designated by arrows 118) until the flows reach the output plenum 102 (shown in FIG. 4). The flow of the steam, which originated from the regenerator is also illustrated in the right portion of FIG. 5.

The width W of each cartridge 78 is much less than the spaces defined between each pair of spaced apart cartridges 78. This feature provides enhanced cooling of the cartridges 78. Furthermore, the cross sectional area of each cartridge is much less than the surface area of a side face 86 of the cartridge. Thus, a high rate of heat transfer is established.

The cooling is controlled so that the instantaneous mass flow output of condensate is substantially equal to the instantaneous mass flow input of propellant, and the total accumulated mass flow output of condensate is adjusted to be equal to the accumulated mass flow input of propellant.

Thus, the only outside source of power required to run the power system 10 is that needed to run the electrolysis unit 12. The electrolysis process preferably utilized is of the type known as the "solid polymer electrolysis" process. This technology was developed by United Technologies Corporation. United Technologies Corporation has several patents in this area. U.S. Pat. Nos. 4,950,371; 4,729,932; and 4,657,829 which provide disclosures of this technology are hereby incorporated by reference.

Briefly, in such an electrolysis process, an electrolytic cell stack consisting of an acid solid polymer electrolyte is employed to split the condensate water from the steam exhaust, into gaseous hydrogen and oxygen. The process is basically well understood as water electrolysis with the aid of acid electrolyte immobilized in a porous polymer matrix. The conductive electrolyte is capable of achieving several orders of magnitude in ion transport (electric current density) over the familiar laboratory setup of two electrodes immersed in a beaker of water. The solid polymer electrolyte membrane also serves as a separator of the product gases.

Electrical DC power input for the electrolysis unit is preferably provided by microwave transmission means. A rectenna device (rectifying antenna) is used for converting microwave energy into DC power. The power collecting rectenna consists of an array of antenna elements that are individually connected to rectifying diodes and a power combining grid. Each element of the array includes a dipole antenna to absorb the microwave energy, a low pass filter to prevent the re-transmission of generated harmonics, a diode to rectify the microwave energy, and an output filter to smooth the DC output. The DC circuit connections may be in either series or parallel, depending upon the load requirements. Obviously, the lunar or other vehicle, for which the present power cycle is intended, is capable of roving to various locations. To capture maximum incoming rf power independent of the vehicle position or orientation, a scanning capability should be included to track the relative position of the transmitting source. Directional rf sensors could be included to provide the position sensing function. The transmitter for providing the rf microwave power could, for example, utilize a Klystron amplifier which drives a parabolic antenna.

As can be readily understood, although conceived for use with lunar mechanisms, the principles of the present invention may be utilized for terrestrial operations offering significant environmental advantages over presently used internal combustion engines.

Obviously, many modifications and variations of the present invention are possible in light of the above teachings. It is therefore to be understood that, within the scope of the appended claims, the invention may be practiced otherwise than as specifically described. For example, although the power system 10 has been described for use with $H_2O$ as the working fluid other fluids may be used, for example hydrogen peroxide. What is imperative is that the combustion efflux be combinable with a third product to form a working fluid, the third product having the same atomic and molecular constituents as the fuel and the oxidizer.

What is claimed and desired to be secured by Letters Patent of the United States is:

1. A staged combustor, comprising:

a housing;

a first combustion stage contained within said housing for combusting a fuel rich mixture of a fuel and an oxidizer;

a plurality of serially positioned secondary combustion stages contained within said housing and located downstream said first stage each of said plurality of secondary combustion stages includes means for receiving secondary flows of said oxidizer to the mass of combustion efflux produced from the first combustion stage, the gradual increase of oxidizer/fuel ratios providing a resultant substantially stiochiometric combustion, said combustion stages being comprised of a plurality of combustor cartridges, each cartridge having said plurality of serially disposed catalyst bed compartments for promoting combustion in a controlled manner, a first of said catalyst bed compartments providing said first combustion stage, said fuel being $H_2$ and said oxidizer being $O_2$; and, means for cooling said combustion stages comprising coolant passageways formed by spaces between said cartridges, said housing including:

steam inlet means at a forward end thereof for the introduction of a flow of coolant steam to said coolant passageways;

oxidizer inlet means for introducing oxidizer to said plurality of combustor cartridges;

fuel inlet means for introducing fuel to said plurality of first catalyst bed compartments; and, an outlet at an aft end for discharging a combined flow of combustion products and coolant steam.

2. The staged combustor of claim 1, wherein each said combustor cartridge includes an alternating series of said catalyst bed compartments and mixing chambers, said mixing chambers being in fluid communication with said oxidizer inlet means for promoting diffusion and mixing of the fuel and oxidizer flows.

3. The staged combustor of claim 2, wherein each catalyst bed compartment is packed with a hydrogen oxidizer catalyst.

4. The staged combustor of claim 3 wherein said hydrogen oxidizer catalyst comprises an activated crushed aluminum oxide coated with a precious earth metal.

5. The staged combustor of claim 3, wherein each said combustor cartridge includes a plurality of heat transfer fins extending from side surfaces thereof.

6. A staged combustor, comprising:

a) a housing, including, steam inlet means at a forward end thereof for the introduction of a flow of coolant steam;

oxidizer inlet means for introducing oxidizer therein;

fuel inlet means for introducing fuel therein; and, an outlet at an aft end; and, b) a plurality of spaced, combustor cartridges disposed within said housing substantially parallel to a longitudinal axis thereof, each cartridge having an alternating series of axially-spaced mixing chambers and catalyst bed compartments forming combustion stages for enhancing combustion, forwardly disposed mixing chambers of said combustor cartridges being in fluid communication with said fuel inlet means, said oxidizer inlet means being in fluid communication with said mixing chambers disposed at desired axial positions within said cartridges, the introduction of fuel at said forwardly disposed mixing chamber resulting in fuel rich combustion at the forward portions of the combustor cartridges, the resultant gradual addition of oxidizer in said mixing chambers providing substantially stiochiometric combustion, spaces between said cartridges being in fluid communication with said steam inlet means, said spaces forming coolant steam passageways, the flow of coolant steam therein providing cooling of said combustor cartridges, the resulting combustion products mixing with said coolant steam at said outlet to form a mixed efflux.

7. The combustor of claim 6 wherein said fuel is $H_2$ and said oxidizer is $O_2$.

8. The combustor of claim 7 wherein each mixing chamber contains granular particles formed of nickel-based alloys for promoting mixing.

9. The combustor of claim 8 wherein each said catalyst bed compartment is packed with an activated, crushed aluminum oxide coated with a precious earth metal.

* * * * *